US006395694B1

(12) United States Patent
Littau

(10) Patent No.: US 6,395,694 B1
(45) Date of Patent: May 28, 2002

(54) DETERGENTS AND CLEANERS COMPRISING NARROW HOMOLOG DISTRIBUTION OF ALKOXYLATED FATTY ACID ALKYL ESTERS

(75) Inventor: Cheryl Ann Littau, Charlotte, NC (US)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/430,731

(22) Filed: Oct. 29, 1999

(30) Foreign Application Priority Data

Oct. 31, 1998 (DE) ..... 198 50 223

(51) Int. Cl.[7] ..... C11D 17/00

(52) U.S. Cl. ..... 510/276; 510/421; 510/422; 510/479; 510/488; 510/506

(58) Field of Search ..... 510/276, 235, 510/422, 488, 506, 421, 479

(56) References Cited

U.S. PATENT DOCUMENTS

| | | | |
|---|---|---|---|
| 5,220,046 | A | 6/1993 | Leach et al. |
| 5,386,045 | A | 1/1995 | Weerasooriya et al. |

FOREIGN PATENT DOCUMENTS

| | | |
|---|---|---|
| DE | 195 09 752 | 9/1996 |
| EP | 0 335 295 | 10/1989 |
| EP | 0 814 152 | 12/1997 |
| JP | 6-116599 | 4/1994 |
| WO | WO 90/13533 | 11/1990 |
| WO | WO 91/15441 | 10/1991 |
| WO | WO 93/02176 | 2/1993 |
| WO | WO 96/05284 | 2/1996 |
| WO | WO 98/00510 | 1/1998 |
| WO | WO 98/00511 | 1/1998 |

OTHER PUBLICATIONS

Article, Littau C, et al., "Optimization of Surfactant Systems Containing Methyl Ester Ethoxylates", 11/98 XP–00078430.

Article, Cox M, et al., "Methyl Ester Ethoxylates", AOCS Press, 1997.

Derwent Patent Family Report and/or Abstract for Japan Patent No. 6–116599.

Derwent Patent Family Report and/or Abstract for German Patent No. 195 097 52.

Derwent Patent Family Report and/or Abstract for EPO Patent No. 0 814 152.

Derwent Patent Family Report and/or Abstract for EPO Patent No. 0 335 295.

*Primary Examiner*—Necholus Ogden
(74) *Attorney, Agent, or Firm*—Richard P. Silverman

(57) ABSTRACT

Detergents and cleaners which comprise fatty acid alkyl ester alkoxylates of the formula $$R^1—COO(AO)_n—R^2$$

with narrow homolog distribution, where $R^1$ is a straight-chain or branched alkyl or alkenyl group having from 5 to 22, preferably from 8 to 18, carbon atoms, $R^2$ is $C_1$–$C_6$-alkyl or $C_2$–$C_6$-alkenyl, preferably methyl, AO is a $C_2$–$C_4$-alkylene oxide unit, and n is a number from 1 to 20, preferably from 3 to 12, in particular from 4 to 10, and these fatty acid alkyl ester alkoxylates contain less than 14% by weight of compounds with a content of no more than (a–3) —AO groups and less than 16% by weight of compounds with a content of not below (a+3) —AO groups, where A is the number of —AO groups with the maximum frequency.

7 Claims, No Drawings

DETERGENTS AND CLEANERS COMPRISING NARROW HOMOLOG DISTRIBUTION OF ALKOXYLATED FATTY ACID ALKYL ESTERS

FIELD OF THE INVENTION

The invention relates to solid and liquid detergents and cleaners comprising fatty acid alkyl ester alkoxylates having very narrow homolog distribution as skin-friendly, low-foaming and environmentally compatible surfactant having very good detergency and good solubility behavior.

DESCRIPTION OF THE RELATED ART

Modern detergents and cleaners, whether in solid or in liquid form, are available commercially as formulations with high concentrations of detersive substances. Advantages in this connection are the minimizing of transportation, storage and packaging costs, and improved handling for the consumer. However, a problem for the manufacturer of liquid concentrates and solid, in particular compressed, products with high surfactants contents is an unfavorable dissolution behavior in aqueous liquor.

It is known that anionic surfactants, for example alkylsulfates, in high concentrations, i.e. in amounts above 8% by weight, in particular in combination with nonionic surfactants, lead to considerable gel formation and thus to poorer flushability in the washing machine.

In order to avoid gel formation during the preparation or storage of liquid detergents and in order to achieve suitable viscosities of the formulations, non-surface-active organic solvents are frequently added. For example, in the specifications WO 98/00510 and WO 98/00511, nonaqueous liquid detergents are described which comprise, as solubility promoter, approximately 20% by weight of polyethylene glycols or glycol ethers. It is desirable to be able to dispense with compounds which exhibit no or little detersive ability.

WO 93/102176 proposes a process for the preparation of solid detergents and cleaners with high bulk density, in which, to improve the dissolution behavior, structure breakers, for example polyethylene glycol or polypropylene glycol, their sulfates and/or disulfates, sulfosuccinates and/or sulfosuccinates or mixtures thereof, are used.

The solubility of detergents and cleaners can also be improved by increasing the surfactant content, in particular by the use of nonionic surfactants, for example ethoxylated fatty alcohols. A disadvantage is that the solid detergent particles stick together, as a result of which the flowability and the flushability is impaired.

Ethoxylated fatty alcohols in liquid concentrates tend to form a gel phase upon dilution with water. Although other surfactant systems in detergents and cleaners impart good solubility to the composition, they exhibit poorer detergency, meaning that relatively large amounts of detergent and cleaner must be used.

Another aim in the preparation of detergents and cleaners is to supply compositions with high detersive substance contents and low foam formation.

The Japanese patent application Heisei 6-116 599 describes granular detergents which comprise fatty acid alkyl ester alkoxylates as nonionic surfactants to improve the solubility.

EP-A-0 814 152 describes the preparation of solid detergents and cleaners comprising, as anionic surfactant, $C_8$–$C_{22}$-alkylsulfates in solid form and from 3 to 20% by weight, based on the $C_8$–$C_{22}$-alkylsulfates, of carboxylic acid alkyl ester alkoxylates.

DE-A-195 09 752 claims a process for the preparation of compressed detergents and cleaners with a high bulk density, where, as solid constituents, anionic surfactants, builder substances and alkylating agents are used, and, as liquid constituents, nonionic surfactants with more than 50% by weight of fatty acid alkyl ester alkoxylates, based on the nonionic surfactant content, are used. WO 96/05284 describes nonaqueous bleach-containing liquid detergents and cleaners comprising from 20 to 78% by weight of nonionic surfactants, preferably fatty acid methyl ester ethoxylates.

The fatty acid alkyl ester alkoxylates mentioned in DE-A-195 09 752 and in WO 96/05284 can, according to the information therein, be prepared by the process described in WO 91/15441 and WO 90/13533 by alkoxylation of fatty acid esters in the presence of hydrophobicized hydrotalcites or calcinated hydrotalcites as catalysts.

In U.S. Pat. No. 5,220,046 and U.S. Pat. No. 5,386,045, it is shown that the alkoxylation of fatty acid alkyl esters in the presence of the catalysts sodium hydroxide, sodium methoxide or hydrotalcites leads to products with a high content of unreacted fatty acid alkyl ester and a relatively broad distribution of fatty acid alkyl ester alkoxylates.

The object of the invention was to develop liquid and solid detergents and cleaners which exhibit good solubility and low gel formation, low foam formation and also improve detergency compared with the prior art.

SUMMARY OF THE INVENTION

The object is achieved according to the invention by preparing aqueous or nonaqueous detergents and cleaners which comprise such fatty acid alkyl ester alkoxylates which, compared with the prior art, have a considerably narrower homolog distribution.

The invention provides detergents and cleaners which comprise fatty acid alkyl ester alkoxylates of the Formula 1

$$R^1—COO(AO)_n—R^2 \quad (1)$$

where $R^1$ is a straight-chain or branched alkyl or alkenyl group having from 5 to 22, preferably from 8 to 18, carbon atoms, $R^2$ is $C_1$–$C_6$-alkyl or $C_2$–$C_6$-alkenyl, preferably methyl, AO is a $C_2$–$C_4$-alkylene oxide unit, and n is a number from 1 to 20, preferably from 3 to 12, in particular from 4 to 10, and these fatty acid alkyl ester alkoxylates contain less than 14% by weight of compounds with a content of not more than (a−3) —AO groups and less than 16% by weight of compounds with a content of not below (a+3) —AO groups, where a is it the number of —AO groups with the maximum frequency.

DESCRIPTION OF THE PREFERRED EMBODIMENTS

An essential feature of the present invention is the narrow homolog distribution of the alkoxylation products as defined above. This definition will be described in more detail below for a compound of the Formula 1 with the maximum frequency of the —AO groups of 10 (a=10). For this case, the amount of alkoxylated analogous compounds which contain 7 and less than 7 —AO groups (a−3) should be less than 14% by weight. Conversely, the amount of alkoxylated compounds with a degree of alkoxylation of 13 or more than 13 should be less than 16% by weight.

The same applies to the fatty acid alkyl ester alkoxylates with other numbers for the maximum frequency of the —AO groups. The homolog distribution defined in this way is significantly narrower than in the case of the fatty acid alkyl ester alkoxylates, as are obtained in the case of the products by the process described in WO 90/13533 and WO 91/15441, and the compounds defined here having a narrower homolog distribution are notable for significantly better detergency and low gel formation during the dissolution procedure. The compounds of the Formula 1 defined in this way are referred to below as "narrow range" fatty acid alkyl ester alkoxylates.

The "narrow range" fatty acid alkyl ester alkoxylates of the Formula 1 having the given narrow homolog distribution and used in the detergents and cleaners according to the invention can be prepared by two different methods:

1. By alkoxylation, in particular ethoxylation, of fatty acid alkyl esters in the presence of a catalyst or a catalyst mixture.

For the synthesis of the "narrow range" fatty acid alkyl ester alkoxylates according to the invention, the following catalysts are suitable: alkaline earth metal salts of monoesters of dicarboxylic acids and alkoxylated alcohols, as described in EP-A-337 239. Here, the nonesterified carboxyl group is converted completely into the form of the alkaline earth metal salt.

Partially neutralized Ca salts of succinic acid half-esters substituted by $C_8$–$C_{30}$-alkyl radicals (EP-A-657 410); alkali metal and alkaline earth metal compounds from the group of the hydroxides, oxides and alkoxides (EP-A-0 335 295); Ca/Al-containing and Ca/Ti-containing catalyst systems (U.S. Pat. No. 5,220,046).

Particularly suitable alkoxylation catalysts are partially neutralized alkaline earth metal salts of dicarboxylic acid half-esters as described in DE 198 07 991.5.

"Narrow range" fatty acid alkyl ester alkoxylates of the Formula 1 can also be prepared by direct esterification of "narrow range" alkoxylated alkyl alcohols or hydroxyalkyl alcohols, for example methylpolyglycols with fatty acid in the presence of an acidic catalyst.

Acidic catalysts which can be used for esterifications are customary catalysts such as sulfuric acid, p-toluenesulfonic acid, alkylsulfonic acids, alkylarylsulfonic acids, $ZnCl_2$, phosphoric acids etc.

The detergents and cleaners according to the invention can be in powder form, granule form and tablet form, i.e. be in the form of solid detergents and cleaners, or as liquid formulations, for example as dishwashing detergents.

For the preparation of powders, a procedure is preferred where firstly a premix of detergent constituents without fatty acid alkyl ester alkoxylate is prepared and then the fatty acid alkyl ester alkoxylate is sprayed on. In another process, pulverulent detergents and cleaners can be prepared by, in the case of the alkoxylate, producing a low viscosity, if necessary by heating, spraying in a spray tower and at the same time adding solid detergent constituents, for example zeolites, kieselguhr, magnesium-aluminum, sodium or calcium aluminosilicates, activated silica or aluminum oxide.

It is also possible to combine the two processes such that a powder prepared by the first process and coated with fatty acid alkyl ester alkoxylate is admixed in a second step with a fatty acid alkyl ester alkoxylate sprayed in a spray tower.

For the preparation of builder agglomerates, comprising fatty acid alkyl ester alkoxylates, powder mixtures are prepared from solid and liquid detergent constituents, and the liquid fatty acid methyl ester ethoxylate, possibly warmed or dissolved in a solvent, is sprayed on and mixed.

For the preparation of granules, firstly the mixture of fatty acid alkyl ester alkoxylates and pulverulent mixtures of solid and liquid detergent and cleaner constituents are thoroughly mixed in a mixing unit (e.g. plowshare mixer). In a second step, the mixture is compressed to give relatively large particles. Roller compactors are inter alia suitable for this purpose. The compacts are then subjected to comminution (grinding) and comminuted to the desired particle size. Toothed-disk rollers and/or sieves are suitable for this purpose.

Fines and coarse material are sieved off and returned to the process. While the coarse material is introduced directly to renewed comminution, the fines are added to the compacting stage. The particle size of the product is generally in the range from 100–2000 $\mu$m, preferably 300–1800 $\mu$m. The bulk density of the granules according to the invention is above 500 kg/m$^3$, preferably above 600 kg/m$^3$.

For the preparation of shaped granules, a process is preferred in which fatty acid alkyl ester alkoxylates are homogeneously mixed together with other liquid and solid detergent constituents, and, with addition of a plasticizer and/or lubricant, the mixture is compressed to give strands via perforated dies having opening widths of the predetermined granular dimension at high pressures between 25 and 200 bar. Immediately after exiting from the perforated mold, the strand is cut to the predetermined granular dimension using a cutting device. Preferred plasticizing agents and/or lubricants are aqueous solutions of polymeric polycarboxylates and highly concentrated anionic surfactant pastes and nonionic surfactants.

The granules obtained in this manner are suitable for direct use in detergents and cleaners. They can additionally be provided with a coating.

For this, the granules according to the invention are coated in an additional step with a film-forming substance, as a result of which the product properties can be significantly influenced.

Suitable coating agents are all film-forming substances, nonionic surfactants, for example fatty acid alkyl ester alkoxylates, anionic surfactants and cationic surfactants, and anionic and cationic polymers, e.g. polyacrylic acid, waxes, silicones, fatty acids and soaps. Preference is given to using coating substances having a melting point of 30–100° C. By using these coating materials, it is possible to influence inter alia dissolution behavior, to reduce the dust content, to increase abrasion resistance and to improve storage stability. If the granules are to be used in machine dishwashing detergents, waxes having melting points of from 40 to 50° C. are especially suitable. The coating materials are usually applied by spraying on coating materials in molten form or dissolved in a solvent. The coating material can be applied to the granule core in amounts of 0–20% by weight, preferably 1–10% by weight, based on the total weight.

Tablets can be prepared, for example, by metering in building substances, for example zeolites, kieselguhr, magnesium-aluminum, sodium or calcium aluminosilicates, activates silica or aluminum oxide, and homogeneously mixing all other constituents, such as surfactants, enzymes, bleach activators, brighteners etc. homogeneously, and compressing the mixture using traditional tableting presses, for example eccentric presses, hydraulic presses or rotary presses with compacting pressures in the range from 300 bar, advantageously in the range from about 5 to 200 bar and in particular between 10 and 50 bar. In a preferred embodiment, the premixes destined for compression can, however, be prepared by mixing the individual ingredients at least proportions of which are present in preformulated form as granular compounds. These include, for example, roller-compacted crystalline layered or amorphous sodium disilicates which have optionally been impregnated with liquid to wax-like components, for example nonionic surfactants.

The "narrow range" fatty acid alkyl ester alkoxylates can be used alone or in admixture with other nonionic surfactants, for example with alkyl- and/or alkenyloligoglycosides, fatty alcohol polyglycol ethers, alkylphenol polyglycol ethers, fatty acid polyglycol esters, fatty acid amide polyglycol ethers, fatty amine polyglycol ethers, alkoxylated triglycerides, fatty acid glucamides, polyoleic fatty acid esters, sugar esters, sorbitan esters and polysorbates and/or alkoxylated fatty alcohols. These other nonionic surfactants further include the customary fatty acid alkyl ester alkoxylates having broad homolog distribution. In the finished composition, the nonionic surfactants can in total be present in an amount of from 1 to 25% by weight, preferably from 2 to 20% by weight, particularly preferably from 10 to 15% by weight, based on the total amount. The content of "narrow range" fatty acid alkyl ester alkoxylates in the total amount of nonionic surfactants can be from 10 to 100% by weight, preferably from 35 to 95% by weight, in particular from 45 to 90% by weight.

Other components which can be used are structure breakers, in particular ethoxylated $C_8$–$C_{18}$ fatty alcohols having from 20 to 45 EO, preferably tallow fatty alcohols having 30 and 40 EO, polyethylene glycol or polypropylene glycol, sulfates and/or disulfates of polyethylene glycol or polypropylene glycol, sulfosuccinates and/or disulfosuccinates of polyethylene glycol or polypropylene glycol or mixtures of these. Other suitable disintegrants are physically modified disintegrants such as sorbitols, dextrins, in particular maltodextrins. The nonionic surfactants and the structure breakers can be used in a weight ratio of nonionic surfactant to structure breaker of from 1:1 to 15:1.

In addition to the surfactants described above, anionic surfactants may be present. Typical examples of anionic surfactants are alkylbenzene-sulfonates, alkanesulfonates, olefinsulfonates, alkyl ether sulfonates, alkylpolyglycol ether sulfonates, glycerol ether sulfonates, alpha-methyl ester sulfonates, sulfofatty acids, alkylsulfates, fatty alcohol ether sulfates, glycerol ether sulfates, hydroxy mixed ether sulfates, monoglyceride(ether) sulfates, fatty acid amide (ether) sulfates, sulfosuccinates, sulfosuccinamates, sulfotriglycerides, $C_6$–$C_{18}$ fatty acid amide ether sulfates, fatty acid soaps, alkylcarboxylates, ether carboxylic acids, isethionates, sarcosinates, taurides, alkyloligoglucoside sulfates, acyllactylates and alkyl (ether) phosphates. The anionic surfactants can be in the form of their sodium, potassium and amonium salts, and as soluble salts of organic bases, such as mono-, di- or triethanolamine.

In a preferred embodiment, in addition to the "narrow range" fatty acid alkyl ester alkoxylates and also other nonionic surfactants, secondary $C_8$–$C_{12}$-alkanesulfonate, in particular $C_{12}$–$C_{18}$-alkanesulfonate, for example that obtainable under the trade name Hostapur SAS (Clariant GmbH), optionally in admixture with $C_8$–$C_{18}$, in particular $C_{12}$–$C_{16}$-ether sulfate, but also alkylbenzenesulfonates, primary and secondary alkylsulfates and fatty acid ester sulfonates are used as anionic surfactants.

The content of anionic surfactants is from 2 to 50% by weight, preferably from 5 to 40% by weight, in particular from 8 to 30% by weight, based on the total amount of surfactants.

Other possible detersive constituents of the compositions according to the invention are amphoteric or zwitterionic surfactants, such as alkylbetains, alkylamidobetains, aminopropionates, aminoglycinates, imidazolinium-betains and sulfobetains.

The solid detergents and cleaners according to the invention can comprise customary builders in amount of from 2 to 80% by weight, preferably in an amount of from 15 to 65% by weight, based on the composition.

Suitable builder substances are zeolites, amorphous alkali metal silicates, carbonate-silicate compounds, crystalline silicates, preferably phyllosilicates, for example the d-disilicate obtainable under the trade name SKS-6 (Clariant GmbH), kieselguhr, magnesium-aluminum, sodium or calcium aluminum silicates, activated silica, aluminum oxide or mixtures of said substances.

Other builders which may be present are also polymeric carboxylates or polymeric carboxylic acids in amounts of from 2 to 15% by weight, based on the total contents. Polymeric carboxylates or polymeric carboxylic acids having a relative molecular mass of at least 350 in the form of their water-soluble salts, in particular in the form of the sodium and/or potassium salts, are suitable, such as polyacrylates, polyhydroxyacrylates, polymethacrylates, polymaleates and, in particular, copolymers of acrylic acid with maleic acid or maleic anhydride, preferably those comprising from 50 to 70% of acrylic acid and from 50 to 10% of maleic acid. The relative molecular mass of the homopolymers is generally between 1000 and 100,000, that of the copolymers is between 2000 and 200,000, preferably from 50,000 to 120,000, based on the free acid. Also suitable are copolymers of acrylic acid or methacrylic acid with vinyl ethers, such as vinyl methyl ether, vinyl esters, ethylene, propylene and styrene, in which the content of acid is at least 50% by weight. Instead of said copolymers, it is also possible to use terpolymers. These organic builders can be present in an amount of from 2 to 20% by weight, preferably from 5 to 15% by weight, based on the composition.

Other organic builders are, for example, the polycarboxylic acids preferably used in the form of their sodium salts, such as citric acid, adipic acid, succinic acid, glutaric acid, tartaric acid, sugar acid, aminocarboxylic acid, nitriloacetic acid and mixtures of these.

The detergents according to the invention preferably comprise peroxy bleaches and, in particular, bleaches in combination with bleach activators. The bleaches used are sodium perborate tetrahydrate, sodium perborate monohydrate, sodium percarbonate, peroxypyrophosphate, citrate perhydrate and $H_2O_2$-supplying peracidic salts or peracids, such as perbenzoates, peroxophthalates, diperoxyazeleic acid or diperoxydodecanedioic acid. Representative examples of bleach activators are N or O-acyl compounds, for example polyacylated alkylenediamines, in particular N,N,N',N"-tetraacetylethylenediamine (TAED), acylated glycolurils, in particular tetraacetylglucoluril (TAGU), N-acylated hydantoins, triazoles, triazines, urazoles, diketopiperazines, sulfurylamides and cyanurates, also carboxylic anhydrides, in particular phthalic anhydride, carboxylic esters, in particular sodium isononanoyloxybenzenesulfonate and acylated sugar derivatives, in particular pentaacetylglycose, glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylcyanic acid (TACA), di-N-acetyldimethylglyoxine (ADMG) and 1-phenyl-3-acetylhydantoin (PAH), amido ester compounds, and cationic bleach activators, for example ammonium nitriles. Bleaches are used in the weight amounts from 5 to 30% by weight, preferably from 8 to 25% by weight, and bleach activators are used in amounts from 1 to 15% by weight, preferably from 2 to 10% by weight.

Other suitable ingredients are soil-release polymers, in particular polymers which comprise ethylene terephthalate, polyoxyethylene terephthalate, propylene glycol, polypropylene glycol, alkylene- or alkylenedicarboxylic acids, isophthalic acid, carboxy- or sulfo-substituted phthalic acid isomers as monomer units and also terminally capped derivatives.

Suitable as salts or extenders are, for example, alkali metal sulfates, alkali metal carbonates, alkali metal bicarbonates, amorphous silicates or mixtures thereof.

The other detergent constituents, the content of which is generally from 0.1 to 5% by weight, include foam inhibitors, optical brighteners, enzymes, softeners, colorants and fragrances. Neutral salts may also be present, in an amount up to 20% by weight, preferably up to 10% by weight, and also antiredeposition agents, in amounts [lacuna], preferably from 0.1 to 5% by weight, for example water-soluble, mostly organic colloids such as soluble starch preparations, aldehyde starches etc. Carboxymethylcellulose (Na salt), methylcellulose, methylhydroxyethylcellulose and mixtures thereof, and polyvinylpyrrolidone are preferably used.

Suitable foam inhibitors are, for example, organopolysiloxanes and their mixtures with microfine, optionally silanized silica, and paraffins, waxes, microcrystalline waxes and mixtures thereof with silanized silica, and mixtures of silicone oil, paraffin oil or waxes.

The compositions according to the invention can comprise, as optical brighteners, diaminostilbenedisulfonic acid or its alkali metal salts. The maximum content of brighteners is 0.5% by weight. Amounts from 0.02 to 0.25% by weight are preferably used.

Suitable enzymes are those from the class of proteases, lipases, amylases, cellulases, peroxydases or oxydases or mixtures thereof. The content of enzymes can be from 0.2 to 8% by weight, preferably from 0.1 to 3% by weight.

If the detergents and cleaners according to the invention are in liquid form, they are preferably aqueous formulations which comprise from approximately 30 to 70% by weight of water.

The products according to the invention are notable for very good storage stability in liquid, pulverulent or compressed detergent, cleaner and disinfectant formulations coupled with simultaneously high active content.

They are ideal for use in standard detergents, stain-removal salts, machine dishwashing detergents and all-purpose cleaners.

The examples below serve to illustrate the invention in more detail without limiting it thereto.

EXAMPLES

All percentages are percentages by weight

Example 1

Standard Detergent

| | | |
|---|---|---|
| Composition: | SKS-6 | 20% |
| | Zeolite | 23% |
| | Hostapur SAS (powder) | 10% |
| | Sodium soap | 2% |
| | $C_{12}$–$C_{14}$ + 7.5 EO NRFAAEE | 15% |
| | Perborate | 15% |
| | TAED | 5% |
| | PEG 600 | 3% |
| | Citric acid | 3.5% |
| | Sodium bicarbonate | 2.0% |
| | Starch | 1.0% |
| | Antifoam | 0.5% |

Example 2

Standard Detergent

| | | |
|---|---|---|
| Composition: | SKS-6 | 20% |
| | Zeolite | 23% |
| | $C_{10}$–$C_{14}$-LAS | 10% |
| | Sodium soap | 1% |
| | $C_{12}$–$C_{14}$ + 7.5 EO NRFAAEE | 12% |
| | $C_{12}$–$C_{14}$ + 4 EO NRFAAEE | 5% |
| | Perborate | 15% |
| | TAED | 5% |
| | Citric acid | 3.5% |
| | Sodium bicarbonate | 4% |
| | Starch | 1.0% |
| | Antifoam | 0.5% |

Example 3

Standard Detergent

| | | |
|---|---|---|
| Composition: | SKS-6 | 20% |
| | Zeolite | 15% |
| | Hostapur SAS (powder) | 10% |
| | Sodium soap | 2% |
| | $C_{12}$–$C_{14}$ + 7.5 EO NRFAAEE | 10% |
| | Genapol = A 3070 | 6% |
| | Perborate | 15% |
| | TAED | 5% |
| | PEG 600 | 3% |
| | Citric acid | 3.5% |
| | Sodium bicarbonate | 1.5% |
| | Starch | 1.0% |
| | Antifoam | 0.5% |

Example 4

Liquid Detergent, Aqueous

| | | |
|---|---|---|
| Composition: | $C_{10}$–$C_{14}$-LAS | 5% |
| | $C_8$–$C_{18}$ + 8 EO NRMEE | 53% |
| | Soap | 10% |
| | SRC 1 | 2% |
| | Sodium sulfate | 1% |
| | Citric acid, sodium salt | 1% |
| | Perfume, dye | |
| | Water | 28% |

Example 5

Liquid Detergent, Aqueous

| | | |
|---|---|---|
| Composition: | $C_{10}$–$C_{14}$-LAS | 9.0% |
| | $C_8$–$C_{18}$ + 8 EO NRMEE | 10% |
| | Soap | 15% |
| | Genapol LA 050 | 3.0% |
| | Citric acid, sodium salt | 3.0% |
| | Borax | 1.0% |
| | Enzymes | |
| | Sodium sulfate | 1.0% |
| | Optical brightener | |
| | Perfume, dye | |
| | Water | 58% |

Example 6

Liquid Detergent Concentrate, Nonaqueous

| | | |
|---|---|---|
| Composition: | $C_{10}$–$C_{14}$-LAS | 5.0% |
| | $C_8$–$C_{18}$ + 7.5 EO NRMEE | 30% |
| | $C_8$–$C_{18}$ + 5 EO NRMEE | 10% |
| | Soap | 0.5% |
| | Genapol LA 050 | 7.0% |
| | Citric acid, sodium salt | 12.0% |
| | SKS-6 | 6.0% |
| | Enzymes | |
| | Perborate (monohydrate) | 20% |
| | TAED | 6% |
| | SRC-1 | 2% |
| | Enzymes | 1% |
| | Optical brighteners | 0.5% |

List of commercial products used:

| | |
|---|---|
| Hostapur ® SAS, powder | secondary alkanesulfonate, sodium salt (about 93% detersive substance (Clariant GmbH) |
| SKS-6 | crystalline phyllosilicate (Clariant GmbH) |
| Zeolite 4A | Wessalith P (Degussa) |
| $C_{12}$–$C_{14}$ + 7.5 EO NRFAAEE (a = 7.5) | "narrow range" $C_{12}$–$C_{14}$ fatty acid alkyl ester ethoxylate (7.5 EO) |
| $C_{12}$–$C_{14}$ + 4 EO NRFAAEE (a = 4) | "narrow range" $C_{12}$–$C_{14}$ fatty acid alkyl ester ethoxylate (4 EO) |
| $C_8$–$C_{18}$ + 8 EO NRMEE (a = 8) | "narrow range" $C_8$–$C_{18}$ methyl ester methoxylate (8 EO) |
| $C_8$–$C_{18}$ + 7.5 EO NRMEE (a = 7.5) | "narrow range" $C_8$–$C_{18}$ methyl ester methoxylate (7.5 EO) |
| $C_8$–$C_{18}$ + 5 EO NRMEE (a = 5) | "narrow range" $C_8$–$C_{18}$ methyl ester methoxylate (5 EO) |
| TAED | N,N,N',N"-tetraacetylethylenediamine |
| Enzymes | Proteases, amylases, lipases |
| PEG 600 | Polyethylene glycol (molecular mass 600) |
| Genapol ® OA 3070 | $C_{14}$–$C_{15}$oxo alcohol polyglycol ether having 3 EO and 7 EO (Clariant GmbH) |
| Sodium soap | $C_8$–$C_{18}$ fatty acid carboxylate, sodium |
| $C_{10}$–$C_{14}$-LAS | linear $C_{10}$–$C_{14}$-alkylbenzenesulfonate, Na salt |
| Genapol | $C_{12}$–$C_{14}$ fatty acid alcohol ethoxylate having 5 EO |
| SRC1 | Soil release polymer (Clariant GmbH) |

The compounds referred to as "narrow range" correspond to the definition in claim 1.

Detergency

To determine the detergency of "narrow range" atty acid alkyl ester alkoxylates and, for comparison therewith, of fatty acid alkyl ester alkoxylates having broad homolog distribution, linitest experiments were carried out with "narrow range" $C_{12}$–$C_{14}$ fatty acid methyl ester ethoxylate $C_{12}$–$C_{14}$-NRMEE+7.6 EO, "narrow range" $C_8$–$C_{14}$ fatty acid methyl ester ethoxylate $C_8$–$C_{18}$ NRMEE+7 EO, "narrow range" $C_8$–$C_{18}$ fatty acid methyl ester ethoxylate+10.4 EO and the "broad range" fatty acid methyl ester ethoxylates $C_{12}$–$C_{14}$ BRFSME+6.7 EO and $C_{12}$–$C_{14}$ BRFSME+10.9 EO. Linitest conditions: 40° C., 30 minutes washing time, surfactant conc.: 2 g/l, water hardness 10° German hardness or 18° German hardness, test fabric: 65:35 polyester/cotton soiling with skin grease (WFK 20 D) or mineral oil (WFK 20 M), obtained from Krefeld Laundry Research.

| | Delta reflectants WFK 20 D | | Delta reflectants WFK 20 M | |
|---|---|---|---|---|
| Product | 18° Gh | 10° Gh | 18° Gh | 10° Gh |
| NRFAAEE $C_{12}$–$C_{14}$ + 7.6 EO | 24.4 | 28.93 | 13.72 | 14.13 |
| NRFAAEE $C_8$–$C_{18}$ + 7 EO | 26.33 | 27.48 | 13.71 | 14.17 |
| BRFSME + 6.7 EO | 10.01 | 8.25 | 8.27 | 11.71 |
| NRFAAEE $C_8$–$C_{18}$ + 10.4 EO | 11.58 | 11.73 | 9.02 | 10.92 |
| BRFAAWE $C_{12}$–$C_{14}$ + 10.9 EO | 6.25 | 6.5 | 8.82 | 8.15 |

What is claimed is:

1. A detergent or cleaner which comprises fatty acid alkyl ester alkoxylates having a narrow homolog distribution of fatty acid alkyl ester alkoxylates of the formula 1

$$R^1—COO(AO)_n—R^2$$

where $R^1$ is a straight-chain or branched alkyl or alkenyl group having from 8 to 18 carbon atoms, $R^2$ is $C_1$–$C_6$-alkyl or $C_2$–$C_6$-alkenyl, AO is a $C_2$–$C_4$-alkylene oxide unit, and n is a number from 4 to 10 and the narrow homolog distribution of fatty acid alkyl ester alkoxylates contains less than 14% by weight of compounds with a content of not more than (a–3) —AO groups and less than 16% by weight of compounds with a content of not below (a+3) —AO groups where a is the number of —AO groups with a maximum frequency, whereby said detergent or cleaner exhibits an improved detergency as measured by delta reflectance.

2. The detergent or cleaner as claimed in claim 1, which comprises, in addition to the fatty acid alkyl ester alkoxylates of the Formula 1, anionic surfactants.

3. The detergent or cleaner as claimed in claim 1, which comprises, in addition to the fatty acid alkyl ester alkoxylates of the Formula 1, fatty acid alkyl ester alkoxylates having a broad homolog distribution outside said narrow homolog distribution of fatty acid alkyl ester alkoxylates.

4. The detergent or cleaner as claimed in claim 1, wherein the total amount of nonionic surfactants is from 1 to 25% by weight.

5. The detergent or cleaner as claimed in claim 1, which comprises fatty acid alkyl ester alkoxylates of the Formula 1 in an amount of from 10 to 100% by weight, based on the total amount of nonionic surfactants.

6. The detergent or cleaner as claimed in claim 1, wherein $R^2$ is methyl.

7. The detergent or cleaner as claimed in claim 1, further comprising other nonionic surfactants providing a total amount of nonionic surfactants.

* * * * *